US007726973B1

(12) United States Patent
Perry

(10) Patent No.: US 7,726,973 B1
(45) Date of Patent: Jun. 1, 2010

(54) POWER CORD QUICK DISCONNECT ASSEMBLY AND ASSOCIATED METHOD

(76) Inventor: Jocelyn Perry, 14887 W. Heritage Dr., Wheatfield, IN (US) 46392

( * ) Notice: Subject to any disclaimer, the term of this patent is extended or adjusted under 35 U.S.C. 154(b) by 0 days.

(21) Appl. No.: 12/378,723

(22) Filed: Feb. 19, 2009

Related U.S. Application Data

(60) Provisional application No. 61/065,880, filed on Feb. 19, 2008.

(51) Int. Cl.
*H01R 11/30* (2006.01)

(52) U.S. Cl. ..... 439/39; 439/40

(58) Field of Classification Search ..... 439/38–40
See application file for complete search history.

(56) References Cited

U.S. PATENT DOCUMENTS 3,363,214 A 1/1968 Wright ..... 439/39

*Primary Examiner*—Ross N Gushi

(57) ABSTRACT

The power cord assembly preferably includes an electrical outlet socket adapted to electrically coupled to the existing power source. The electrical outlet socket may have a first group of electro-conductive plates statically affixed to an outer surface thereof. A power cord is also provided, which remains physically spaced from the electrical outlet socket. An adaptor may be removably coupled directly to the power cord. Such an adaptor preferably has a second group of electro-conductive plates statically affixed to an outer surface thereof. The present invention further includes a mechanism for continuously transmitting an electric current from the electrical outlet socket through the adaptor and to the power cord while the first and second groups of electro-conductive plates are abutted against each other. The adaptor remains intermediately positioned between the electrical outlet socket and the power cord during continuous transmission of the electric current to the power cord.

12 Claims, 7 Drawing Sheets

POWER CORD QUICK DISCONNECT ASSEMBLY AND ASSOCIATED METHOD

CROSS REFERENCE TO RELATED APPLICATIONS

This application claims the benefit of U.S. Provisional Application No. 61/065,880, filed Feb. 19, 2008, the entire disclosures of which are incorporated herein by reference.

STATEMENT REGARDING FEDERALLY SPONSORED RESEARCH OR DEVELOPMENT

Not Applicable.
Not Applicable.

REFERENCE TO A MICROFICHE APPENDIX

Not Applicable.

BACKGROUND OF THE INVENTION

1. Technical Field

This invention relates to power cords and, more particularly, to a power cord quick disconnect assembly for providing users with a convenient means of quickly and easily disconnecting a power cord from a wall mounted electrical socket.

2. Prior Art

An appliance coupler enables the connection and disconnection at will, of a cord to an appliance or other equipment and it consists of two parts: a connector and an appliance inlet. Often the connector takes the form of a plug while the appliance inlet takes the form of a socket. Typically the cord is intended to deliver electrical power such as AC or DC current to the appliance. Alternatively, a cord may be intended to serve as the conductor for the transmission of data.

It is common that where an electrical connection is effected by utilization of a plug and socket, the combination must be capable of being connected and disconnected by the plug being inserted and withdrawn from the socket with the use of no more than a strength or force which may be easily exerted by unaided manual effort. The minimum force required to disconnect the plug and socket may be referred to as the withdrawal force. The withdrawal force is exerted by way of a pull force which is a force applied to the plug and socket combination which tends to separate the connection.

Notwithstanding the ease by which a plug may be disconnected from a socket, there may be situations such as when the apparatus is operating where the plug is required to withstand a pull force that is significantly greater than the withdrawal force. These otherwise conflicting requirements may be satisfied by the provision of a retaining component that operates independently of the retaining effect achieved by the otherwise unaided plug and socket combination.

Generally, the plug and corresponding socket are configured to slidably engage one another, the socket having slots to a depth of at least the length of the pins. The pins may protrude from a support structure or be integral with the support structure. The pins may be constructed from a conductor, such as metal or some combination of support structure having a conductive component. The slots are generally housed within a structure having insulating properties.

Generally there is a frictional retaining force between the pins and their corresponding slots. In addition, in some plug and socket arrangements, the housing of each of the respective plug and socket provides a frictional retaining force. This frictional retaining force will tend to oppose a pull force and thus contribute to the level of withdrawal force required to cause a disconnection to the plug and socket.

A problem with the known arrangements for retaining the connectors and appliance inlet together is that the withdrawal force is either too low to satisfy some operation situations in that the connector disconnects from the appliance inlet when subject to pull forces that are often encountered in the operating environment. Alternatively, the withdrawal force is so high that physical damage may result to the connector and appliance inlet before the connector disconnects from the appliance inlet.

For example, in the case where a screw is used to hold the connector and appliance inlet together, other parts of the connector and appliance inlet may break before the screw disengages. Where such an arrangement to be used for power cables, it may be that live wires break or become exposed to the environment before the screw disengages or the appliance may be otherwise damaged.

As a further undesirable consequence, the connector may separate from the attached power cord or the appliance inlet may separate from the rest of the appliance. In each instance the separation of components may cause short circuits or even live electrical leads to be exposed to the environment thereby giving rise to a situation where further appliance damage, electrocution, arcing and ignition of fire may occur. Further, the power cord, connector, appliance inlet or retaining device may become damaged and rendered in a condition that would be unsuitable for further use.

Accordingly, a need remains for a power cord quick-disconnect assembly in order to overcome the above-noted shortcomings. The present invention satisfies such a need by providing an assembly that is convenient and easy to use, is durable yet lightweight in design, is versatile in its applications, and provides a convenient means of disconnecting a power cord from a power outlet.

BRIEF SUMMARY OF THE INVENTION

In view of the foregoing background, it is therefore an object of the present invention to provide a combined power cord, adaptor and electrical outlet socket for safely transmitting an electric current to an electronic device. These and other objects, features, and advantages of the invention are provided by a power cord assembly for safely transmitting electric current from an existing power source to an existing electronic device.

The power cord assembly preferably includes an electrical outlet socket adapted to electrically coupled to the existing power source. The electrical outlet socket may have a first group of electro-conductive plates statically affixed to an outer surface thereof. A power cord is also provided, which remains physically spaced from the electrical outlet socket. An adaptor may be removably coupled directly to the power cord. Such an adaptor preferably has a second group of electro-conductive plates statically affixed to an outer surface thereof. Advantageously, the first group of electro-conductive plates are aligned with the second group of electro-conductive plates when the respective outer surfaces of the electrical outlet socket and the adaptor are abutted together.

The present invention further includes a mechanism for continuously transmitting an electric current from the electrical outlet socket through the adaptor and to the power cord while the first and second groups of electro-conductive plates are abutted against each other. In this manner, the adaptor remains intermediately positioned between the electrical outlet socket and the power cord during continuous transmission of the electric current to the power cord. As will be appreciated by one skilled in the art, an entire surface area of the adaptor preferably remains disposed exterior of the electrical outlet socket during the continuous transmission of the electric current.

In one embodiment, the continuous electric current transmitting mechanism preferably comprises a first magnetic member dynamically seated within the electric outlet socket. A second magnetic member may be statically seated within the adaptor. In particular, the first and second magnetic members are oppositely polarized and thereby create an attracting magnetic field therebetween such that the first magnetic is linearly reciprocated towards the outer face of the electrical outlet socket when the adaptor is adjoined thereto.

Therefore, the first and second groups of electro-conductive plates preferably remain continuously abutted together when the first magnetic member is linearly displaced away from a resting position and thereby juxtaposed towards the second magnetic member.

The continuous electric current transmitting mechanism further comprise a plurality of linear channels formed within the electrical outlet socket, as well as a plurality of spring members anchored at proximal ends of selected ones of, the channels respectively. A plurality of electro-conductive contacts may be fixedly coupled to distal ends of the spring members respectively.

In one embodiment, the first magnetic member is dynamically situated within another one of the channels as well as statically coupled to the spring members respectively. In this manner, each of the electro-conductive contacts as well as the first magnetic member may be caused to linearly reciprocate in sync along a corresponding one of the channels when the second magnetic member is adjoined to the outer surface of the electrical outlet socket.

Advantageously, each of the spring members and the corresponding conductive contacts as well as the first magnetic member automatically retract in sync to an equilibrium position defined at the proximal end of the channels respectively. For example, the conductive contacts are preferably caused to linearly reciprocate along the corresponding channels as the first and second magnetic members are removably adjoined to each other such that the first group of electro-conductive plates becomes isolated from the electric current when the conductive contacts are retracted to the equilibrium positions respectively.

In one embodiment, each of the electro-conductive contacts directly engages a corresponding one of the first group of electro-conductive plates after reaching a distal end of the corresponding channel such that the electric current is directly transmitted to the first group of electro-conductive plates respectively.

In one embodiment, the electric current is preferably transmitted from the first group of electro-conductive plates directly to the second group of electro-conductive plates while the outer surface of the adaptor is abutted against the outer surface of the electrical outlet socket.

The present invention further includes a method for safely transmitting electric current from an existing power source to an existing electronic device. Such a method preferably includes the chronological steps of: providing and electrically coupling an electrical outlet socket to the existing power source. The electrical outlet socket has a first group of electro-conductive plates statically affixed to an outer surface thereof.

The method may further include the chronological steps of: providing a power cord; maintaining the power cord physically spaced from the electrical outlet socket; and providing and removably coupling an adaptor directly to the power cord. The adaptor preferably has a second group of electro-conductive plates statically affixed to an outer surface thereof.

The method may further include the chronological steps of: aligning the first group of electro-conductive plates with the second group of electro-conductive plates by abutting the respective outer surfaces of the electrical outlet socket and the adaptor together. Next, the method may include the chronological step of: continuously transmitting an electric current from the electrical outlet socket through the adaptor and to the power cord while the first and second groups of electro-conductive plates are abutted against each other.

The method may further include the chronological steps of: maintaining the adaptor intermediately positioned between the electrical outlet socket and the power cord during continuous transmission of the electric current to the power cord; and maintaining an entire surface area of the adaptor disposed exterior of the electrical outlet socket during the continuous transmission of the electric current.

The safety and ease of use associated with the present invention proves invaluable to a countless number of potential users who depend on electrical appliances and machines in their daily lives. Such users include, but are not limited to, household users to business owners. The assembly is also very useful to those with physical challenges, like those whose grasping strength has been compromised by arthritis and similar debilitating conditions.

As such, the user need not worry that the simple act of removing a power cord 30 will cause painful exertion, or that they will accidentally damage the power cord 30, or socket 20.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Figure 1:
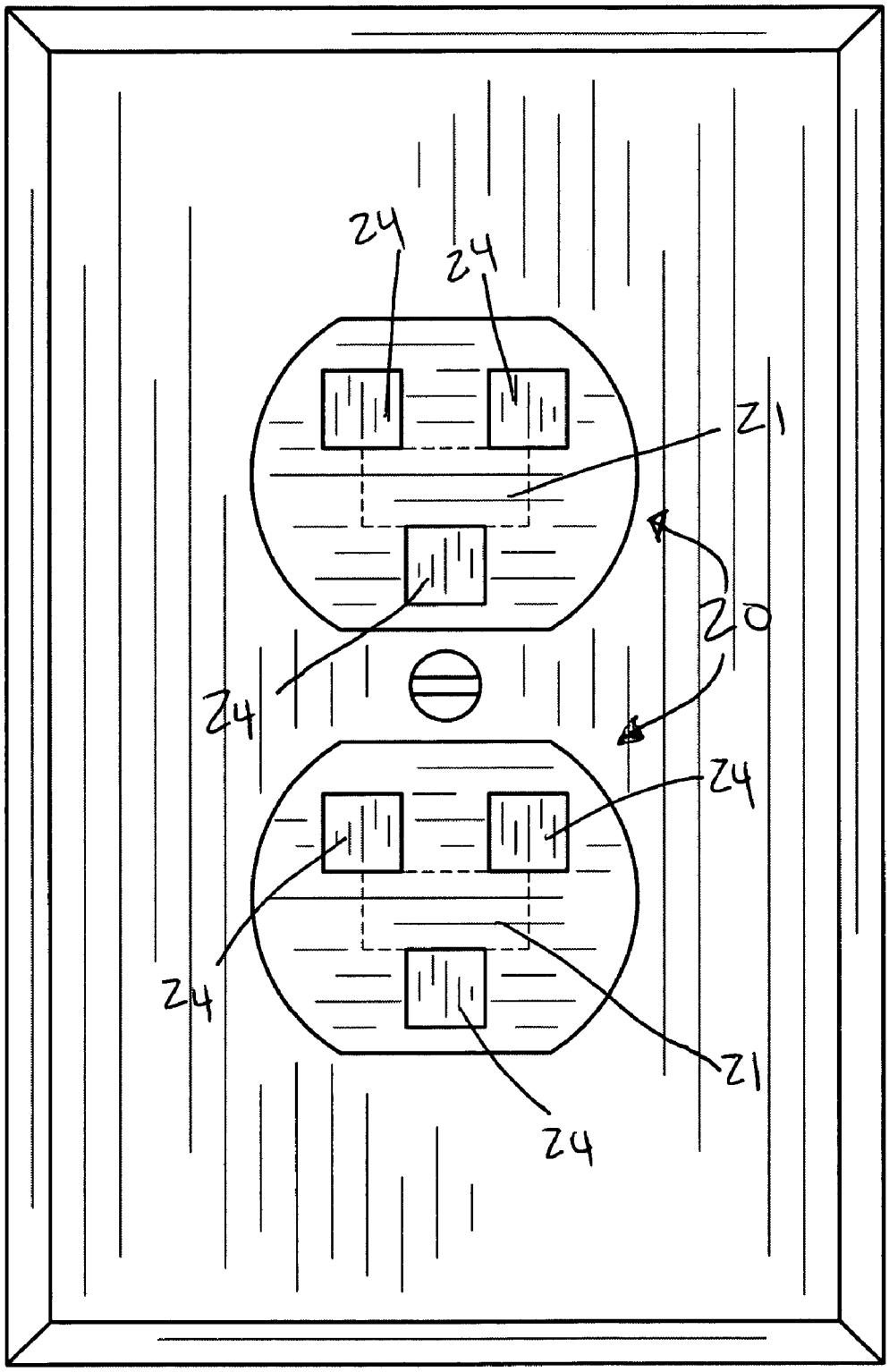
FIG. 1 is a front elevational view showing a pair of electrical outlet sockets, in accordance with the present invention.
Figure 2:
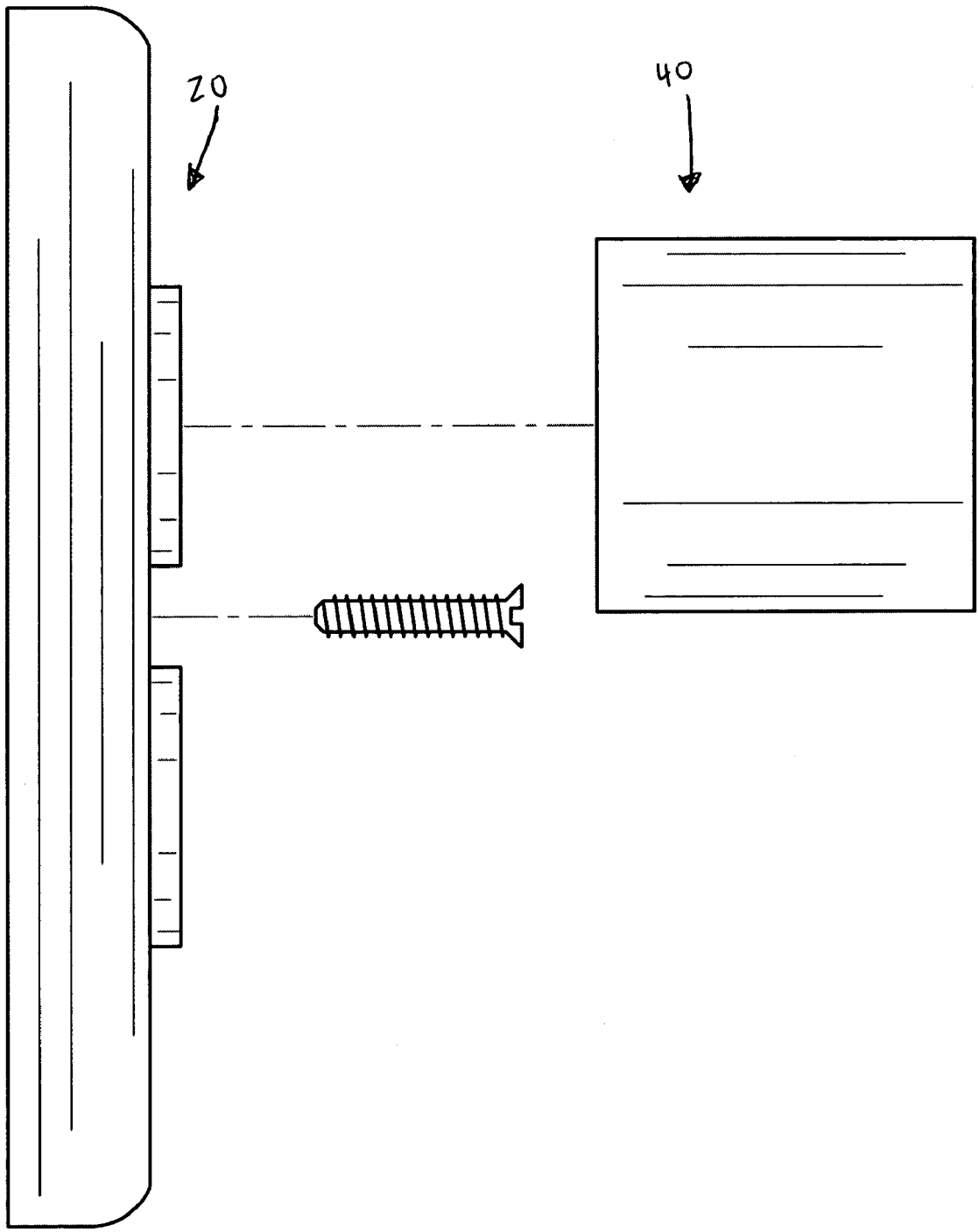
FIG. 2 is a side elevational view showing an outer surface of an adaptor removably abutted against an outer surface of the electrical outlet socket.
Figure 3:
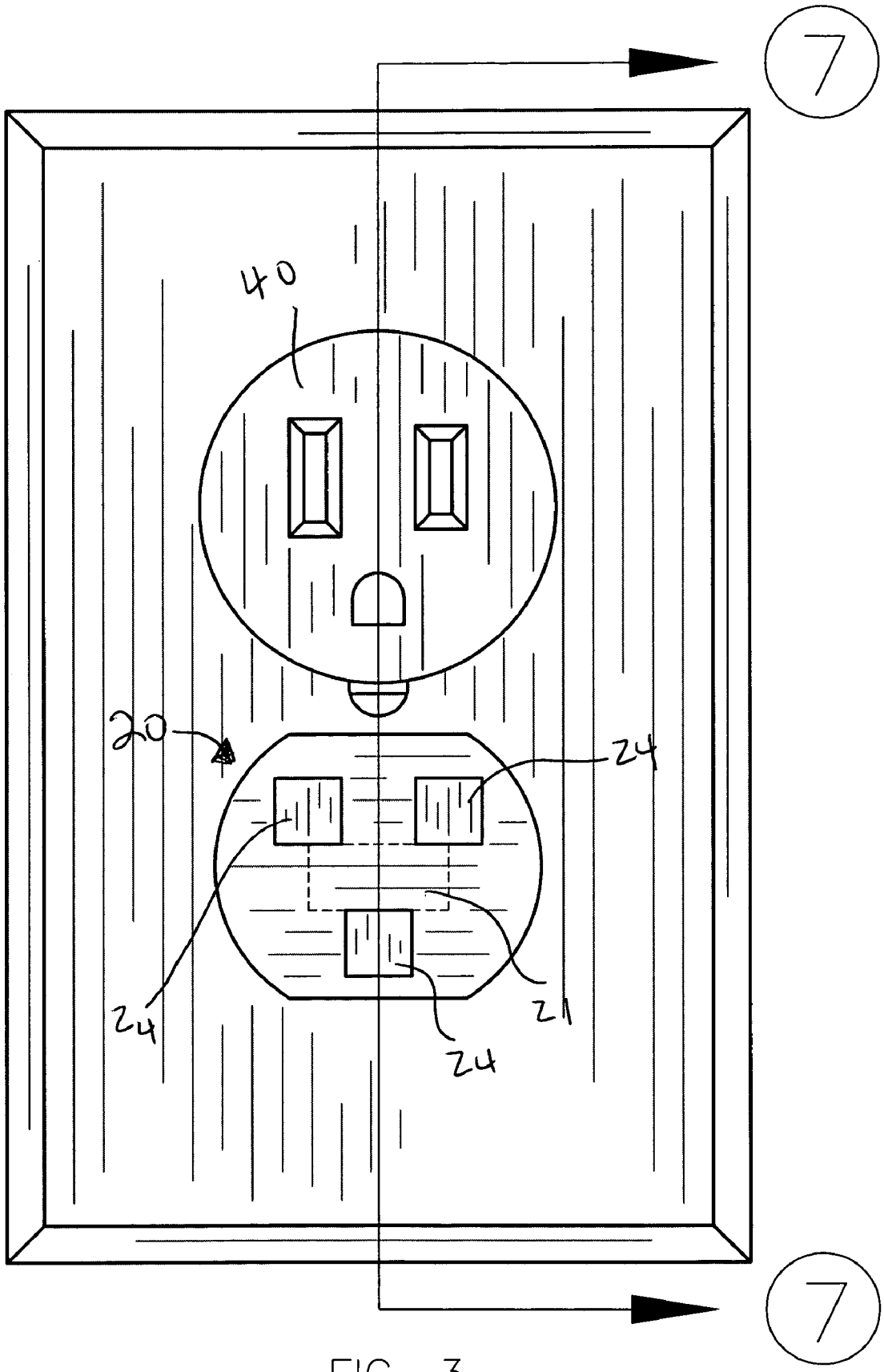
FIG. 3 is a front elevational view showing the adaptor abutted against the electrical outlet socket.
Figure 4:
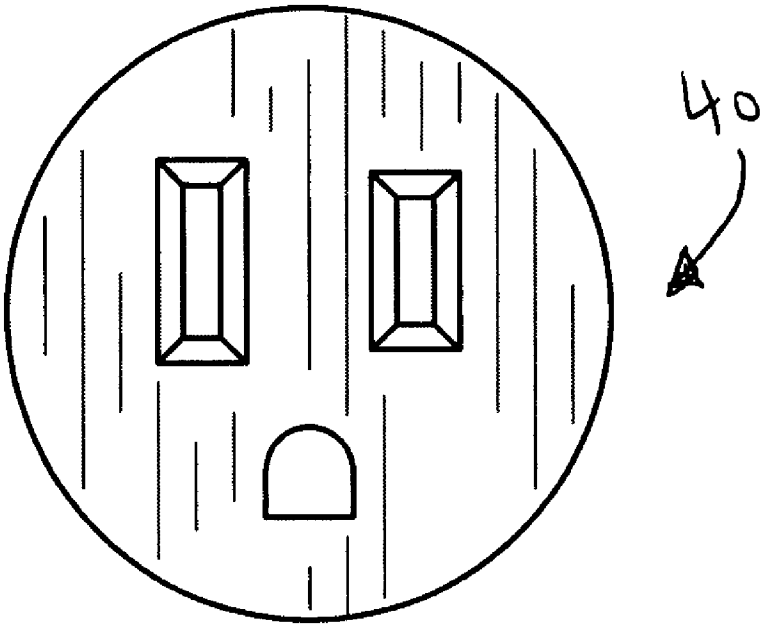
FIG. 4 is a rear elevational view of the adaptor.
Figure 5:
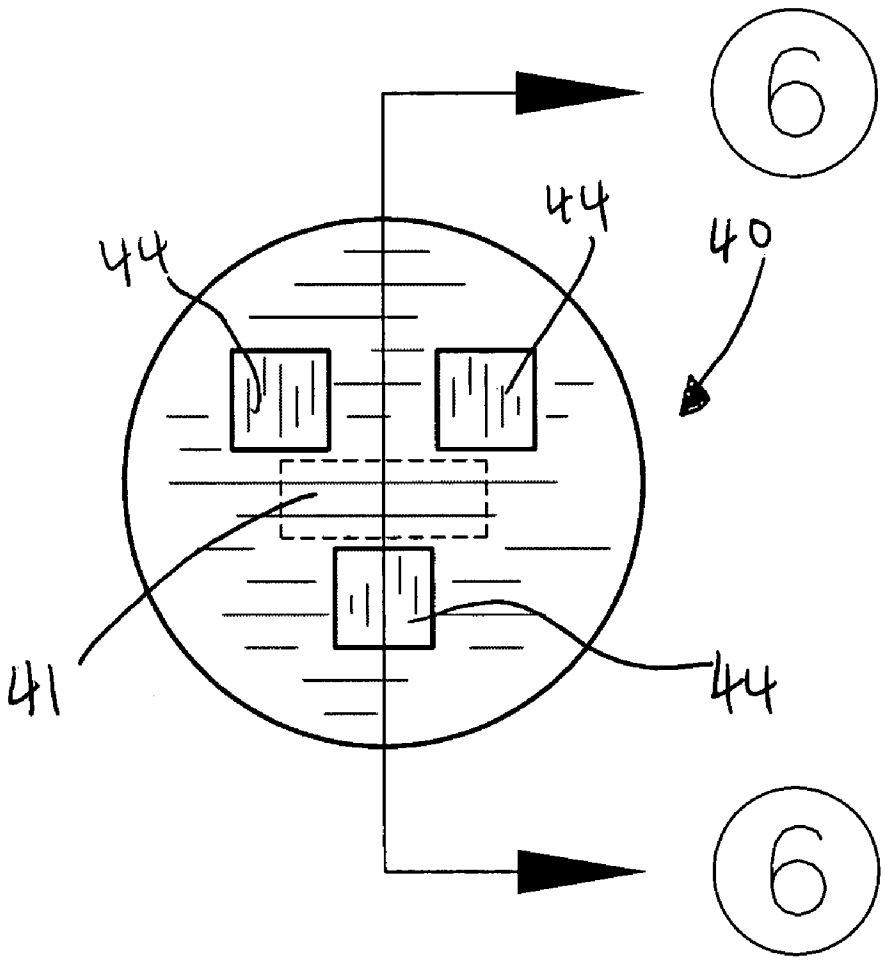
FIG. 5 is a front elevational view of the adaptor.
Figure 6:
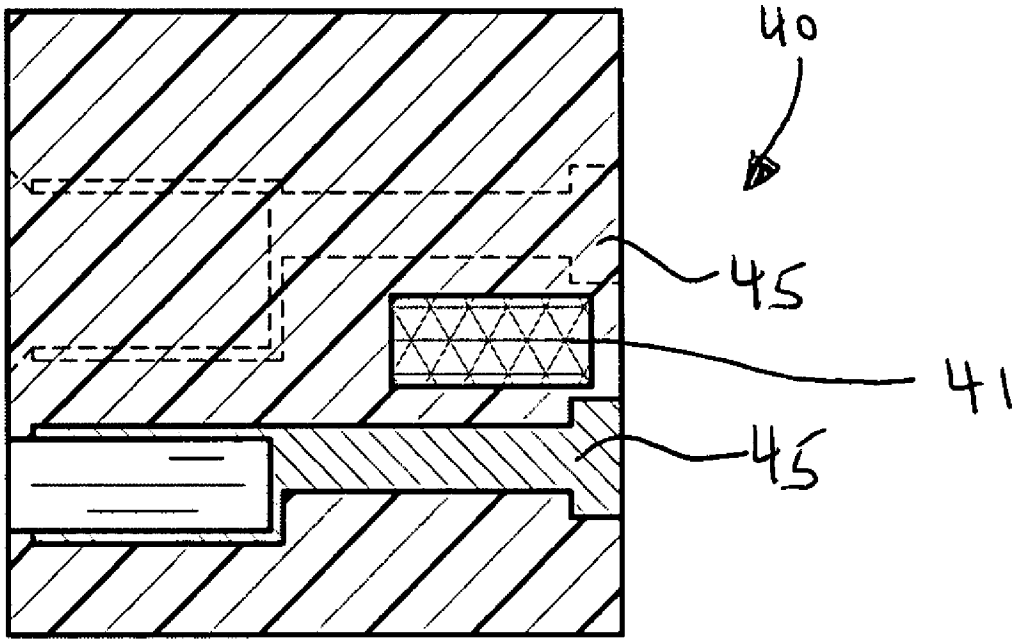
FIG. 6 is a cross-sectional view taken along line 6-6 in FIG. 5.

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention 10 is referred to generally in FIGS. 1-7 by the reference numeral 10 and is intended to provide a combined electrical outlet socket 20, power cord 30 and adaptor 40 for safely transmitting an electric current to an electronic device (not shown) while maintaining the power cord 30 physically spaced apart from the electrical outlet socket 20. It should be understood that the present invention 10 may be used to safely transmit electric current having various amp levels to many different types of electronic devices and should not be construed as limited to any particular embodiment explained herein.

The power cord assembly 10 preferably includes an electrical outlet socket 20 adapted to electrically coupled to the existing power source (not shown). For example, prongs 50 may be hardwired to a fuse box remotely located from the electrical outlet socket 20. The electrical outlet socket 20 may have a first group 24 of electro-conductive plates 24 statically affixed to an outer surface thereof, as perhaps best shown in FIGS. 1 and 3. A power cord 30 is also provided, which remains physically spaced from the electrical outlet socket 20, as perhaps best shown in FIG. 7.

Figure 7:
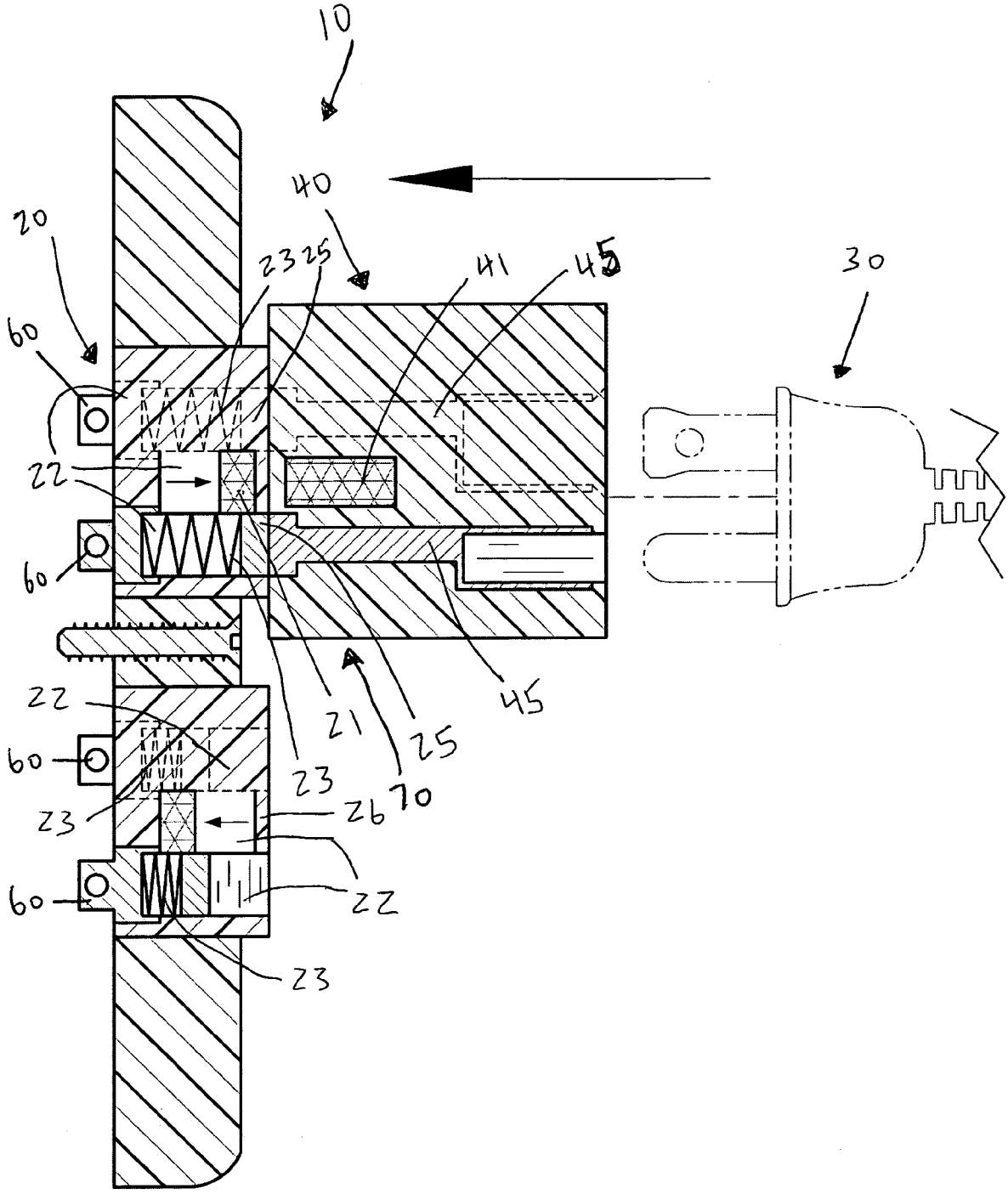
FIG. 7 is a cross-sectional view taken along line 7-7 in FIG. 3.

Still referring to FIG. 7, an adaptor 40 may be removably coupled directly to the power cord 30. Such an adaptor 40 preferably has a second group 44 of electro-conductive plates statically affixed to an outer surface thereof, as perhaps best shown in FIG. 5. Notably, conductive extensions 45 bridge the second group 44 of electro-conductive plates to the opposite end of the adaptor 44, which receives power cord 30 therein such that the electric current is passed through the adaptor 40 and to power cord 30. Advantageously, the first group 24 of electro-conductive plates are aligned with the second group 44 of electro-conductive plates when the respective outer surfaces of the electrical outlet socket 20 and the adaptor 40 are abutted together, as perhaps best shown in FIG. 7.

The present invention 10 further includes a mechanism 70 for continuously transmitting an electric current from the electrical outlet socket 20 through the adaptor 40 and to the power cord 30 while the first 24 and second groups 44 of electro-conductive plates are abutted against each other. In this manner, the adaptor 40 remains intermediately positioned between the electrical outlet socket 20 and the power cord 30 during continuous transmission of the electric current to the power cord 30. As will be appreciated by one skilled in the art, an entire surface area of the adaptor 40 preferably remains disposed exterior of the electrical outlet socket 20 during the continuous transmission of the electric current.

In one embodiment, the continuous electric current transmitting mechanism 70 preferably comprises a first magnetic member 21 dynamically seated within the electric outlet socket 20. A second magnetic member 41 may be statically seated within the adaptor 40. In particular, the first 21 and second magnetic members 41 are oppositely polarized and thereby create an attracting magnetic field therebetween such that the first magnetic member 21 is linearly reciprocated towards the outer face of the electrical outlet socket 20 when the adaptor 40 is adjoined thereto, as perhaps best shown in FIG. 7. Therefore, the first 24 and second groups 44 of electro-conductive plates preferably remain continuously abutted together when the first magnetic member 21 is linearly displaced away from a resting position and thereby juxtaposed towards the second magnetic member 41.

The continuous electric current transmitting mechanism 70 further comprise a plurality of linear channels 22 formed within the electrical outlet socket 20, as well as a plurality of spring members 23 anchored at proximal ends of selected ones of the channels 22 respectively. A plurality of electro-conductive contacts 25 may be fixedly coupled to distal ends of the spring members 23 respectively.

In one embodiment, the first magnetic member 21 is dynamically situated within another one of the channels 22 as well as statically coupled to the spring members 23 respectively. In this manner, each of the electro-conductive contacts 25 as well as the first magnetic member 21 may be caused to linearly reciprocate in sync along a corresponding one of the channels 22 when the second magnetic member 41 is adjoined to the outer surface of the electrical outlet socket 20, as perhaps best shown in FIG. 7.

Advantageously, each of the spring members 23 and the corresponding conductive contacts 25 as well as the first magnetic member 21 automatically retract in sync to an equilibrium position defined at the proximal end of the channels 22, respectively. For example, the conductive contacts 25 are preferably caused to linearly reciprocate along the corresponding channels 22 as the first 21 and second 41 magnetic members are removably adjoined to each other such that the first group 24 of electro-conductive plates becomes isolated from the electric current when the conductive contacts 25 are retracted to the equilibrium positions respectively. This feature prevents accidental electric shock after the adaptor 40 is displaced away from the electrical outlet socket 20.

In one embodiment, each of the electro-conductive contacts 25 directly engages a corresponding one of the first group 24 of electro-conductive plates after reaching a distal end of the corresponding channel 22 such that the electric current is directly transmitted to the first group 24 of electro-conductive plates respectively.

In one embodiment, the electric current is preferably transmitted from the first group 24 of electro-conductive plates directly to the second group 44 of electro-conductive plates while the outer surface of the adaptor 40 is abutted against the outer surface of the electrical outlet socket 20, as perhaps best shown in FIG. 7.

The present invention 10 further includes a method for safely transmitting electric current from an existing power source to an existing electronic device. Such a method preferably includes the chronological steps of: providing and electrically coupling an electrical outlet socket 20 to the existing power source. The electrical outlet socket 20 has a first group 24 of electro-conductive plates statically affixed to an outer surface thereof.

The method may further include the chronological steps of: providing a power cord 30; maintaining the power cord 30 physically spaced from the electrical outlet socket 20; and providing and removably coupling an adaptor 40 directly to the power cord 30. The adaptor 40 preferably has a second group 44 of electro-conductive plates statically affixed to an outer surface thereof.

The method may further include the chronological steps of: aligning the first group 24 of electro-conductive plates with the second group 44 of electro-conductive plates by abutting the respective outer surfaces of the electrical outlet socket 20 and the adaptor 40 together. Next, the method may include the chronological step of: continuously transmitting an electric current from the electrical outlet socket 20 through the adaptor 40 and to the power cord 30 while the first 24 and second groups of electro-conductive plates are abutted against each other.

The method may further include the chronological steps of: maintaining the adaptor 40 intermediately positioned between the electrical outlet socket 20 and the power cord 30 during continuous transmission of the electric current to the power cord 30; and maintaining an entire surface area of the adaptor 40 disposed exterior of the electrical outlet socket 20 during the continuous transmission of the electric current.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A power cord assembly for safely transmitting electric current from an existing power source to an existing electronic device, said power cord assembly comprising:

an electrical outlet socket adapted to electrically coupled to the existing power source, said electrical outlet socket having a first group of electro-conductive plates statically affixed to an outer surface thereof;

a power cord remaining physically spaced from said electrical outlet socket;

an adaptor removably coupled directly to said power cord, said adaptor having a second group of electro-conductive plates statically affixed to an outer surface thereof;

wherein said first group of electro-conductive plates are aligned with said second group of electro-conductive plates when said respective outer surfaces of said electrical outlet socket and said adaptor are abutted together; and means for continuously transmitting an electric current from said electrical outlet socket through said adaptor and to said power cord while said first and second groups of electro-conductive plates are abutted against each other;

wherein said adaptor remains intermediately positioned between said electrical outlet socket and said power cord during continuous transmission of the electric current to said power cord;

wherein said continuous electric current transmitting means comprises:

a first magnetic member dynamically seated within said electric outlet socket; and a second magnetic member statically seated within said adaptor;

wherein said first and second magnetic members are oppositely polarized and thereby create an attracting magnetic field therebetween such that said first magnetic is linearly reciprocated towards said outer face of said electrical outlet socket when said adaptor is adjoined thereto;

wherein said first and second groups of electro-conductive plates remain continuously abutted together when said first magnetic member is linearly displaced away from a resting position and thereby juxtaposed towards said second magnetic member.

2. The power cord assembly of claim 1, wherein said continuous electric current transmitting means further comprises:

a plurality of linear channels formed within said electrical outlet socket;

a plurality of spring members anchored at proximal ends of selected ones of said channels respectively; and a plurality of electro-conductive contacts fixedly coupled to distal ends of said spring members respectively;

wherein said first magnetic member is dynamically situated within another one of said channels, said first magnetic member being statically coupled to said spring members respectively;

wherein each of said electro-conductive contacts as well as said first magnetic member is caused to linearly reciprocate in sync along a corresponding one of said channels when said second magnetic member is adjoined to said outer surface of said electrical outlet socket.

3. The power cord assembly of claim 2, wherein said conductive contacts are caused to linearly reciprocate along said corresponding channels as said first and second magnetic members are removably adjoined to each other such that said first group of electro-conductive plates become isolated from the electric current when said conductive contacts are retracted to said equilibrium positions respectively.

4. The power cord assembly of claim 2, wherein each of said electro-conductive contacts directly engages a corresponding one of said first group of electro-conductive plates after reaching a distal end of said corresponding channel such that said electric current is directly transmitted to said first group of electro-conductive plates respectively.

5. The power cord assembly of claim 4, wherein said electric current is transmitted from said first group of electro-conductive plates directly to said second group of electro-conductive plates while said outer surface of said adaptor is abutted against said outer surface of said electrical outlet socket.

6. The power cord assembly of claim 5, wherein each of said spring members and said corresponding conductive contacts as well as said first magnetic member automatically retract in sync to an equilibrium position defined at said proximal end of said channels respectively.

7. A power cord assembly for safely transmitting electric current from an existing power source to an existing electronic device, said power cord assembly comprising:

an electrical outlet socket adapted to electrically coupled to the existing power source, said electrical outlet socket having a first group of electro-conductive plates statically affixed to an outer surface thereof;

a power cord remaining physically spaced from said electrical outlet socket;

an adaptor removably coupled directly to said power cord, said adaptor having a second group of electro-conductive plates statically affixed to an outer surface thereof;

wherein said first group of electro-conductive plates are aligned with said second group of electro-conductive plates when said respective outer surfaces of said electrical outlet socket and said adaptor are abutted together; and means for continuously transmitting an electric current from said electrical outlet socket through said adaptor and to said power cord while said first and second groups of electro-conductive plates are abutted against each other;

wherein said adaptor remains intermediately positioned between said electrical outlet socket and said power cord during continuous transmission of the electric current to said power cord;

wherein an entire surface area of said adaptor remains disposed exterior of said electrical outlet socket during the continuous transmission of said electric current;

wherein said continuous electric current transmitting means comprises:

a first magnetic member dynamically seated within said electric outlet socket; and a second magnetic member statically seated within said adaptor;

wherein said first and second magnetic members are oppositely polarized and thereby create an attracting magnetic field therebetween such that said first magnetic is linearly reciprocated towards said outer face of said electrical outlet socket when said adaptor is adjoined thereto;

wherein said first and second groups of electro-conductive plates remain continuously abutted together when said first magnetic member is linearly displaced away from a resting position and thereby juxtaposed towards said second magnetic member.

8. The power cord assembly of claim 7, wherein said continuous electric current transmitting means further comprises:

a plurality of linear channels formed within said electrical outlet socket;

a plurality of spring members anchored at proximal ends of selected ones of said channels respectively; and a plurality of electro-conductive contacts fixedly coupled to distal ends of said spring members respectively;

wherein said first magnetic member is dynamically situated within another one of said channels, said first magnetic member being statically coupled to said spring members respectively;

wherein each of said electro-conductive contacts as well as said first magnetic member is caused to linearly reciprocate in sync along a corresponding one of said channels when said second magnetic member is adjoined to said outer surface of said electrical outlet socket.

9. The power cord assembly of claim 8, wherein said conductive contacts are caused to linearly reciprocate along said corresponding channels as said first and second magnetic members are removably adjoined to each other such that said first group of electro-conductive plates become isolated from the electric current when said conductive contacts are retracted to said equilibrium positions respectively.

10. The power cord assembly of claim 8, wherein each of said electro-conductive contacts directly engages a corresponding one of said first group of electro-conductive plates after reaching a distal end of said corresponding channel such that said electric current is directly transmitted to said first group of electro-conductive plates respectively.

11. The power cord assembly of claim 10, wherein said electric current is transmitted from said first group of electro-conductive plates directly to said second group of electro-conductive plates while said outer surface of said adaptor is abutted against said outer surface of said electrical outlet socket.

12. The power cord assembly of claim 11, wherein each of said spring members and said corresponding conductive contacts as well as said first magnetic member automatically retract in sync to an equilibrium position defined at said proximal end of said channels respectively.

* * * * *